US012385482B2

(12) United States Patent
Hayes-Pankhurst et al.

(10) Patent No.: US 12,385,482 B2
(45) Date of Patent: Aug. 12, 2025

(54) PUMP WITH LONGITUDINAL FLOW CHANNELS

(71) Applicant: PSG Germany GmbH, Duisburg (DE)

(72) Inventors: Richard Paul Hayes-Pankhurst, London (GB); Jonathan Edward Ford, London (GB)

(73) Assignee: PSG Germany GmbH, Duisburg (DE)

( * ) Notice: Subject to any disclaimer, the term of this patent is extended or adjusted under 35 U.S.C. 154(b) by 0 days.

(21) Appl. No.: 18/560,367

(22) PCT Filed: May 12, 2022

(86) PCT No.: PCT/EP2022/062908

§ 371 (c)(1),
(2) Date: Nov. 10, 2023

(87) PCT Pub. No.: WO2022/238535

PCT Pub. Date: Nov. 17, 2022

(65) Prior Publication Data

US 2024/0240636 A1 Jul. 18, 2024

(30) Foreign Application Priority Data

May 12, 2021 (GB) ..... 2106738

(51) Int. Cl.
*F04C 5/00* (2006.01)
*F04C 15/00* (2006.01)
*F04C 15/06* (2006.01)

(52) U.S. Cl.
CPC ..... *F04C 5/00* (2013.01); *F04C 15/0015* (2013.01); *F04C 15/06* (2013.01)

(58) Field of Classification Search
CPC ..... F04C 5/00; F04C 15/0015; F04C 15/06
See application file for complete search history.

(56) References Cited

U.S. PATENT DOCUMENTS 3,771,901 A * 11/1973 Svensson ..... F04C 5/00 418/156
9,581,157 B2 * 2/2017 Hayes-Pankhurst ..... F04C 15/0015

(Continued)

FOREIGN PATENT DOCUMENTS

WO WO 2006/027548 3/2006
WO WO 2010/122299 10/2010

(Continued)

OTHER PUBLICATIONS

International Search Report and Written Opinion in International Appln. No. PCT/EP2022/062908, mailed on Sep. 5, 2022, 15 pages.

(Continued)

*Primary Examiner* — Mary A Davis
(74) *Attorney, Agent, or Firm* — Fish & Richardson P.C.

(57) ABSTRACT

A rotary pump (10) comprises a housing (20) having a first (21) and second fluid port (22) and an interior surface defining a cavity (24) in which a rotor (30; 230) is located, wherein the rotor comprises at least a surface recess (231*a*-231*d*) forming at least a fluid-conveying chamber (232*a*-232*d*) with the interior surface of the housing. The pump further comprises at least a resiliently deformable diaphragm (50; 226) providing part of the interior surface of the housing and being urged into contact with the surface of the rotor by the action of pressurising means acting on the rear surface of the resiliently deformable diaphragm. The pump further comprises one or a pair of flow channels (41*a*, 41*b*; 241*a*, 241*b*) associated with the resiliently deformable diaphragm extending longitudinally from opposite ends of the rotor. In embodiments where the pump comprises one flow channel (575), the flow channel is in fluid communication with the first fluid port and an aperture (595) opens from the interior surface of the housing to place the second fluid port in direct fluid flow communication with the fluid-conveying chamber.

(Continued)

In embodiments where the pump comprises a pair of flow channels (241*a*, 241*b*), the pair of flow channels comprise a first flow channel in fluid communication with the first fluid port and closed to the second fluid port and a second flow channel closed to the first fluid port and in fluid communication with the second fluid port, with each flow channel being located at opposite sides of the diaphragm. Embodiments of the invention exhibit continuous fluid flow when in use.

42 Claims, 8 Drawing Sheets

(56) References Cited

U.S. PATENT DOCUMENTS

| | | | | |
|---|---|---|---|---|
| 9,638,204 | B2 * | 5/2017 | Hayes-Pankhurst | F04C 5/00 |
| 10,465,681 | B2 * | 11/2019 | Hayes-Pankhurst | F04C 15/0015 |
| 10,495,085 | B2 * | 12/2019 | Hayes-Pankhurst | F04C 15/0015 |
| 10,935,025 | B2 * | 3/2021 | Hayes-Pankhurst | F04C 15/06 |
| 11,187,228 | B2 * | 11/2021 | Shi | F04C 5/00 |
| 2024/0280100 | A1 * | 8/2024 | Hayes-Pankhurst | F04C 5/00 |

FOREIGN PATENT DOCUMENTS

| | | |
|---|---|---|
| WO | WO 2011/119464 | 9/2011 |
| WO | WO 2013/117486 | 8/2013 |
| WO | WO 2014/135563 | 9/2014 |
| WO | WO 2016/146771 | 9/2016 |

OTHER PUBLICATIONS

International Preliminary Report on Patentability in International Appln. No. PCT/EP2022/062908, mailed on Nov. 23, 2023, 8 pages.

* cited by examiner

PUMP WITH LONGITUDINAL FLOW CHANNELS

The invention relates to pumps.

It is known to provide a pump formed by a housing having an inlet and outlet for a fluid and containing a rotor provided with at least one surface recess that forms with the interior surface of the rotor a chamber that, on rotation of the rotor, conveys fluid from the inlet to the outlet. In order to prevent fluid passing from the outlet to the inlet, a flexible diaphragm is provided on or as part of the housing and is located between the inlet and the outlet. The diaphragm is urged into engagement with the rotor by a pressurising means, which can take many forms such as a block of resilient material, a resilient tube of material, a spring or hydraulic or pneumatic pressure. Pumps of this general kind are disclosed in International patent application number WO2006/027548.

Since such pumps comprise a discrete number of chambers formed by recesses in the rotor surface conveying fluid from an inlet to an outlet, the resulting liquid flow tends to be pulsated, with periods of no flow and periods of high flow. This can be detrimental in some applications, for example, in administering medicine to a patient, where a pulsating flow can be uncomfortable. It is an object of the present invention to provide a pump with improved flow profile.

Attempts have been made to reduce pulsing of fluid flow in pumps such as the rotary infusion pump described in International patent application number WO2011/119464. This document discloses a pump having a housing containing a rotor, wherein the rotor includes a first ring of surfaces that form channels with the housing and a second ring of surfaces that form channels with the housing. The first and second rings being radially offset to dampen pulsing of the flow of fluid through the pump.

In addition, prior art pumps, such as that described in WO2006/027548, have limited design options for location of the inlet and outlet ports and the diameter, or cross-sectional area of these ports. It is another objective of the present invention to provide a pump with improved design flexibility.

Furthermore, it is important to be able to sterilise pumps in many applications, in order that they may be reused. It is an objective of the present invention to provide a pump which can be more easily sterilised.

It is an objective of preferred embodiments of the present invention to provide a rotary pump providing essentially continuous flow. Continuous flow as used herein is defined as a flow where there are no periods of no fluid flow. Continuous flow does not necessarily mean that there is a constant flow rate, there may be some variation in flow rate provided there is always a positive flow of fluid while the pump is operational and supplied with fluid.

Aspects of the invention described herein may be useful alone or in combination with another aspect described herein.

According to a first aspect of the present invention, there is provided a pump comprising, a first fluid port and a second fluid port, a housing having an interior surface defining a cavity in which a rotor is located, a rotor, being rotatably mounted within the housing and having a longitudinal axis of rotation, and comprising, a housing engaging surface area forming a sealing interference fit with the interior surface of the housing, and at least one surface recess that forms with said interior surface of the housing a fluid-conveying chamber that, on rotation of the rotor, conveys fluid from the first fluid port to the second fluid port, a resiliently deformable diaphragm providing part of the interior surface of the housing, the diaphragm comprising a rotor engaging surface and a rear surface opposite the rotor engaging surface, the rotor engaging surface of the diaphragm being urged into contact with the rotor by the action of a pressurising means acting on the rear surface of the diaphragm, a pair of flow channels being associated with the resiliently deformable diaphragm, the flow channels extending longitudinally from opposite ends of the rotor to overlie the surface recess of the rotor as the rotor rotates in use, the pair of flow channels comprising a first flow channel in fluid communication with the first fluid port and being closed to the second fluid port and a second flow channel being closed to the first fluid port and being in fluid communication with the second fluid port, with each flow channel being located at opposite sides of the diaphragm.

According to second aspect of the invention, there is provided a pump comprising, a first fluid port and a second fluid port, a housing having an interior surface defining a cavity in which a rotor is located, a rotor, being rotatably mounted within the housing and having a longitudinal axis of rotation, and comprising, a housing engaging surface area forming a sealing interference fit with the interior surface of the housing, and at least one surface recess that forms with said interior surface of the housing a fluid-conveying chamber that, on rotation of the rotor, conveys fluid from the first fluid port to the second fluid port, a resiliently deformable diaphragm providing part of the interior surface of the housing, the diaphragm comprising a rotor engaging surface and a rear surface opposite the rotor engaging surface, the rotor engaging surface of the diaphragm being urged into contact with the rotor by the action of a pressurising means acting on the rear surface of the diaphragm, a flow channel being associated with a leading edge of the resiliently deformable diaphragm, the flow channel extending longitudinally from one end of the rotor to overlie the surface recess of the rotor as the rotor rotates in use, the flow channel being in fluid communication with the first fluid port, and an aperture opening from the interior surface of the housing and being associated with the following edge of the resiliently deformable diaphragm and located to overlie the surface recess of the rotor as the rotor rotates in use, such that upon rotation of the rotor the second fluid port is in direct fluid flow communication with the fluid-conveying chamber via the aperture.

Suitably, in all aspects of the invention the housing comprises a resilient material, for example, polypropylene, polyethylene, thermoplastic polyurethane or rubber. The first fluid port and/or the second fluid port may extend from the housing. If the first fluid port and/or the second fluid port extend from the housing, the first and/or second fluid port are suitably moulded as a unit with the housing.

The rotor may be made from a rigid material such as stainless steel, polyether ether ketone (PEEK), HDPE or polycarbonate. The choice of material of the housing and rotor are interdependent and should be chosen such that they exhibit a low coefficient of friction at the contacting surfaces.

According to all aspects of the invention, the housing may comprise a single unit providing the interior surface defining the cavity in which the rotor is located, the first fluid port and the second fluid port and optionally the resiliently deformable diaphragm. Alternatively, the housing may provide the interior surface defining the cavity in which the rotor is located, and optionally the resiliently deformable diaphragm, and may be used with first and/or second separate end caps to close the cavity in which the rotor is located. In this embodiment, the first and/or second fluid port may be provided in the housing or in a separate end cap.

A pump according to all aspects of the present invention may comprise one resiliently deformable diaphragm.

Alternatively, a pump according to the first aspect of the present invention may comprise a plurality of resiliently deformable diaphragms. For example, a pump according to the first aspect of the present invention may comprise two resiliently deformable diaphragms. Alternatively, a pump according to the first aspect of the present invention may comprise three resiliently deformable diaphragms. If the pump comprises a plurality of resiliently deformable diaphragms, they are preferably equidistantly arranged about the circumference of the rotor.

In one embodiment of the first aspect of the present invention, the pump comprises two diaphragms, which are located on diametrically opposite sides of the rotor. In an alternative embodiment of the first aspect of the present invention, the pump comprises three diaphragms, which are equidistantly spaced about the circumference of the rotor.

In all aspects of the invention, the or each resiliently deformable diaphragm comprises sides, which sides are the edges of the diaphragm that extend from one end of the cavity in which the rotor is located to the other end of the cavity. In other words, the side edges are longitudinal edges of the diaphragm that extend essentially in the same direction of the longitudinal axis of rotation of the rotor. The sides of the diaphragm may be straight or curved. The or each diaphragm has a leading edge and a following edge, which are determined by the direction of rotation of the rotor in use.

In all aspects of the invention, the resiliently deformable diaphragm may be provided by a section of the housing manufactured to a sufficiently small thickness to have the required deformable resilience. For example, the resiliently deformable diaphragm is provided by a section of the housing that is no more than 1 mm, suitably no more than 0.5 mm and in some embodiments less than 0.1 mm thick. In this embodiment, the housing is preferably made from a resilient thermoplastic or thermoset material and the resiliently deformable diaphragm is unitary with the housing.

Alternatively, in all aspects of the invention the resiliently deformable diaphragm may comprise a section of resiliently deformable elastomeric material which is hermetically attached to or co-moulded with the housing. The separate diaphragm should be attached to the housing so as to create a continuous rotor engaging surface as the interior surface of the housing. If the resiliently deformable diaphragm is a separate elastomeric material, it suitably comprises a thermoplastic elastomer (TPE), or a thermoplastic polyurethane (TPU). If the diaphragm is provided by a separate resiliently deformable elastomeric material, the housing may comprise a resilient material, for example, polypropylene, polyethylene, thermoplastic polyurethane or rubber or the housing could be made of a rigid material.

In use, according to all aspects of the invention, the diaphragm or plurality of diaphragms is operable to prevent direct fluid communication between the first fluid port and the second fluid port, as a result of a fluid-tight contact between the rotor-engaging surface of the diaphragm and the rotor surface. Furthermore, the resiliently deformable nature of the one or plurality of diaphragms means that each diaphragm flexes with the contoured surface of the rotor, such that, in use, the one of more diaphragms are operable to ensure each fluid-conveying chamber is emptied as the rotor rotates.

In all aspects of the invention, the resiliently deformable diaphragm may comprise a rib on the rear surface. Alternatively, a rib may be provided on a spring means providing the pressurising means, arranged such that in use the rib acts on the rear surface of the diaphragm. Suitably, the rib extends along the full length of the diaphragm in a direction parallel to the longitudinal axis of rotation of the rotor.

In all aspects of the invention, any suitable pressurising means may be used to urge the rotor engaging surface of each diaphragm into contact with the rotor. The pressurising means may comprise a spring means acting on the rear surface of the resiliently deformable diaphragm. For example, a pressurising means may comprise a block or tube of resilient material, to which pressure may be applied to urge the spring means against the rear surface of the resiliently deformable diaphragm. Examples of suitable spring members are disclosed in International patent application number WO2013/117486. Alternatively, or in addition, the pressurising means may comprise a fluid applied to the rear surface of the resiliently deformable diaphragm. Examples of pumps comprising fluid applied to the rear surface of the resiliently deformable diaphragm are disclosed in International patent application numbers WO2010/122299 and WO 2014/135563.

In an embodiment of all aspects of the invention, a pump according to the invention may comprise a diaphragm chamber surrounding the rear surface of a resiliently deformable diaphragm.

In all aspects of the invention, the diaphragm chamber may be provided by walls extending from the housing and suitably a separate cap to close the chamber. Alternatively, the diaphragm chamber may comprise a separate unit that is attached to the housing. The diaphragm chamber suitably houses the pressurising means arranged to urge the resiliently deformable diaphragm against the rotor. Each diaphragm chamber may comprise either an open chamber or a closed chamber for locating the pressurising means. The closed chamber may be hermetically sealed.

In all aspects of the invention, the diaphragm chamber may be a closed chamber connected by a passage to the fluid flowing through the pump, such that fluid flowing through the pump provides the pressurising means. The passage providing fluid to the diaphragm chamber may comprise a one-way valve, allowing fluid to flow into the diaphragm chamber, but not out. This one-way valve arrangement allows for sustained pressure on the diaphragm even if the direction of flow of the pump is reversed.

Alternatively, in all aspects of the invention, the diaphragm chamber may be a closed chamber connected by a passage to a separate fluid source, which separate fluid source provides the pressurising means.

In all aspects of the invention, the second fluid port may extend from the diaphragm chamber. Furthermore, if the diaphragm comprises a separate cap to close the chamber, the second fluid port may extend from the cap.

In one embodiment a diaphragm chamber surrounds only one resiliently deformable diaphragm. If the pump comprises more than one diaphragm, an individual diaphragm chamber may surround the rear surface of each of the one or more resiliently deformable diaphragms.

In an alternative embodiment of the first aspect of the invention, comprising a plurality of resiliently deformable diaphragms, the diaphragm chambers may be inter-connected. The plurality of diaphragm chambers may be interconnected by providing a fluid channel between the chambers. This is particularly useful if the second fluid port of the pump extends from the diaphragm chamber and/or if fluid from the first or second chamber provides the pressurising means.

Suitably, in a pump according to the second aspect of the invention, the aperture is formed in the interior surface of the housing adjacent the following edge of the resiliently deformable diaphragm and located to overlie the surface recess of the rotor as the rotor rotates in use. Alternatively, in a pump according to the second aspect of the invention, the aperture is formed in the diaphragm, adjacent the following edge and located to overlie the surface recess of the rotor as the rotor rotates in use. In a further alternative, in a pump according to the second aspect of the invention, the aperture is formed partially in the diaphragm and partially in the interior surface of the housing across the following edge of the diaphragm and located to overlie the surface recess of the rotor as the rotor rotates in use.

The second fluid port is in fluid flow communication with the aperture. In embodiments of a pump according to the second aspect, the aperture may be provided by the second fluid port.

Suitably, in all aspects of the invention, each flow channel comprises a longitudinal channel with an open channel surface and is open at one end and closed at the other end. The open channel surface is coterminous with the surface of the rotor in use, and is in fluid flow communication with the surface of the rotor. Each flow channel may have the same width along the full length thereof. Alternatively, each flow channel, or one or both flow channel in each pair, may taper along the length thereof. If a flow channel is tapered it is suitably at its widest at the open end and at its narrowest at the closed end.

Preferably, in a pump according to the first aspect of the invention, the flow channels in a pair are substantially parallel to each other. If the pump comprises a plurality of pairs of flow channels, it is preferred that all of the flow channels are arranged substantially parallel to one another.

Suitably, in all aspects of the invention, the or each flow channel is linear and orientated to be substantially parallel to the axis of rotation of the rotor. Alternatively, in all aspects of the invention, the or each flow channel may be orientated helically about the longitudinal axis of rotation of the rotor. In the event that the pump comprises a plurality of flow channels, and they are oriented helically about the longitudinal axis of rotation of the rotor, the flow channels are preferably all parallel to one another.

In embodiments of a pump according to the first aspect of the invention, comprising a plurality of resiliently deformable diaphragms a pair of flow channels is associated with each resiliently deformable diaphragm. In embodiments of a pump according to the first aspect of the invention, comprising a plurality of resiliently deformable diaphragms and therefore a plurality of pairs of flow channels, the first and second flow channels are arranged alternately about the circumference of the rotor.

In all aspects of the invention the flow channels may be formed in the interior surface of the housing that defines the chamber in which the rotor is located. In one embodiment of all aspects of the invention, each flow channel or pair of flow channels is provided by recessed channels in the interior surface of the housing.

Alternatively, in all aspects of the invention each flow channel or pair of flow channels are formed in the rotor engaging surface of the diaphragm. In an embodiment of the invention, each flow channel or pair of flow channels is provided by recessed channels in the rotor engaging surface of the diaphragm.

In a preferred embodiment of all aspects of the invention, each flow channel is provided by a channel extending longitudinally along the length of the diaphragm, substantially parallel to the axis of rotation of the rotor, with one longitudinal edge of each channel being defined by the interior surface of the housing and the other longitudinal edge of each channel being defined by the diaphragm.

In the first aspect of the invention the flow channels are axially arranged substantially parallel to the longitudinal axis of rotation of the rotor and are preferably located at opposite side edges of the diaphragm.

The flow channels are formed in the interior surface of the housing defining the cavity in which the rotor is located and/or in the rotor engaging surface of the resiliently deformable diaphragm. In embodiments of the invention where there is more than one flow channel, the plurality of flow channels are circumferentially spaced about the cavity in which the rotor is located.

In all aspects of the invention, the flow channels extend from an end of the rotor to overlie the surface recess of the rotor, and thus the fluid-conveying chamber, as the rotor rotates. The flow channels may extend along substantially the full length of the fluid-conveying chamber formed by the surface recess on the rotor and the interior surface of the housing, providing in the first aspect of the invention, the first flow channel is closed to the second fluid port and the second flow channel is closed to the first fluid port, and provided in the second aspect of the invention, the flow channel is closed to the aperture and it thus not in direct fluid flow connection with the second fluid port.

In all aspects of the invention, each of the flow channels suitably extends along essentially the full length of the diaphragm, providing in the first aspect of the invention, the first flow channel is closed to the second fluid port and the second flow channel is closed to the first fluid port, and provided in the second aspect of the invention, the flow channel is closed to the aperture and it thus not in direct fluid flow connection with the second fluid port.

In a pump according to the first aspect of the invention, since each first flow channel is in fluid communication with the first fluid port and is closed to the second fluid port and each second flow channel is closed to the first fluid port and is in fluid communication with the second fluid port, each flow channel extends from one end of the rotor, but is closed at the other end before reaching the opposite end of the rotor.

In a pump according to the second aspect of the invention, the flow channel is in fluid communication with the first fluid port and is closed at the end of the recess distal the first fluid port such that the flow channel is closed to the aperture.

In a pump according to the first aspect of the invention, each flow channel in a pair is closed at opposite ends. Each of the first flow channels is closed to the second fluid port, such that it is not in direct fluid flow communication with the second fluid port, and each of the second flow channels is closed to the first fluid port, such that it is not in direct fluid flow communication with the first fluid port. In each pair of flow channels, the open end of the first flow channel is in direct fluid flow communication with the first fluid port and the open end of the second flow channel is in direct fluid flow communication with the second fluid port.

If a pump according to the first aspect of the invention comprises more than one pair of flow channels, then the open end of each of the first channels in all of the pairs of flow channels would be in direct fluid flow communication with the first fluid port and the open end of each of the second channels in all of the pairs of flow channels would be in direct fluid flow communication with the second fluid port. Furthermore, none of the second flow channels would be in direct fluid flow communication with the first fluid port and none of the first flow channels would be in direct fluid flow communication with the second fluid port.

In a preferred embodiment of the first aspect of the invention, the pump may comprise a first chamber, a second chamber or a first chamber and a second chamber. Suitably, the first chamber and the second chamber are formed between the interior surface of the housing and the rotor, and are located at opposite ends of the rotor. The first fluid port is suitably in fluid flow communication with the first chamber and the second chamber is suitably in fluid flow communication with the second fluid port. Suitably, the first channel of each pair of flow channels is in direct fluid flow communication with the first chamber, such that in use, fluid flows in through the first fluid port, into the first chamber and from there into the one or more first channels. Suitably, the second channels of each pair of flow channels are in direct fluid flow communication with the second chamber, such that in use, fluid flows from the one or more second channels, into the second chamber and then towards the second fluid port.

The presence of a first chamber advantageously means that a single first fluid port can supply multiple first flow channels. The presence of a second chamber advantageously means that multiple second flow channels can be combined into a single flow stream towards the second fluid port. Furthermore, the presence of a first and/or second chamber has the advantage of allowing greater flexibility of the location of the first fluid port and/or second fluid port on the pump.

The second chamber may be in fluid flow communication with a diaphragm chamber. Furthermore, the diaphragm chamber may be in fluid flow communication with the second fluid port. In this latter case, the fluid flows from the second chamber to the second fluid port via the diaphragm chamber. In an embodiment of the invention, the second chamber is connected to all of the diaphragm chambers.

In an embodiment of the first aspect of the present invention, the second chamber may be provided by a diaphragm chamber. The diaphragm chamber may comprise the second fluid port.

In one embodiment of the first aspect of the invention, where the pump does not comprise a first chamber and a second chamber, the one or more resiliently deformable diaphragms extend between the first fluid port and the second fluid port and the first fluid port and second fluid ports are at opposite ends of the rotor.

In an alternative embodiment of first aspect of the invention, where the pump comprises a first chamber and a second chamber, the one or more resiliently deformable diaphragms extend between the second chamber and the first chamber. In this embodiment the first fluid port and the second fluid port may be at opposite ends of the rotor, but need not be, provided they are in fluid flow communication with the first chamber or the second chamber, respectively.

In an embodiment of the first aspect of the present invention comprising two resiliently deformable diaphragms, a first pair of flow channels is associated with a first diaphragm and a second pair of flow channels is associated with a second diaphragm. In an embodiment of the first aspect of the present invention comprising three resiliently deformable diaphragms, a first pair of flow channels is associated with a first diaphragm, a second pair of flow channels is associated with a second diaphragm and a third pair of flow channels is associated with a third diaphragm.

In all aspects of the invention, the rotor is generally cylindrical and comprises at least one recess that forms with the interior surface of the housing a fluid-conveying chamber. In all aspects of the invention, the surface recess is provided by a concave area of the rotor surface. In all aspects of the invention, the surface recess preferably extends longitudinally along the majority of the axial length of the rotor. In a preferred embodiment, the surface recess does not extend along the whole axial length of the rotor, but preferably extends longitudinally along substantially the whole of the axial length of the rotor.

In embodiments of all aspects of the invention, the rotor has a plurality of surface recesses that form, with said interior surface of the housing, a corresponding plurality of fluid-conveying chambers that, on rotation of the rotor, convey fluid from the first fluid port to the second fluid port. For example, the rotor has two surface recesses that form with said interior surface of the housing two fluid-conveying chambers. In an alternative embodiment of all aspects of the invention, the rotor has three surface recesses that form with said interior surface of the housing three fluid-conveying chambers. The rotor may have four surface recesses that form with said interior surface of the housing four fluid-conveying chambers.

Furthermore, the rotor may have five surface recesses that form with said interior surface of the housing five fluid-conveying chambers. Whilst the rotor of all aspects of the invention may comprise any number of recesses providing a corresponding number of fluid-conveying chambers, the more chambers there are the smaller the volume of fluid that can be conveyed in each chamber for a given rotor diameter and length.

Preferably, if a pump according to any aspect of the invention comprising a plurality of surface recesses, the plurality of surface recesses are arranged circumferentially about the rotor. Preferably, the plurality of surface recesses are equidistantly spaced about the circumference of the rotor. In all aspects of the invention, the plurality of recesses are not arranged to extend longitudinally along the axial length of the rotor.

Suitably, the housing engaging surface area forming a sealing interference fit with the interior surface of the housing comprises the whole surface of the rotor except the one or more surface recesses on the rotor. Preferably the rotor comprises a substantially cylindrical body in which one or more surface recesses are formed. The housing engaging surface area of the rotor suitably comprises a cylindrical area at each end of the rotor in which no recess is formed, which cylindrical areas are connected by elongate sections of the rotor surface separating the longitudinal extent of adjacent recesses. The cylindrical areas at the end of the rotor and the elongate sections between adjacent recesses are connected and in the same cylindrical plane defining the cylindrical surface of the rotor. The elongate sections of the rotor surface separating adjacent recesses provide a land between adjacent recesses on the rotor surface.

Preferably, the pump according to all aspects of the invention the present invention comprises only a single rotor.

The combination of the fluid flow channel(s) and the resiliently deformable diaphragms improves the consistency of the fluid flow rate provided and in some embodiments of the first aspect of the invention, enables the pump to be arranged to provide a continuous flow rate. Different combinations of the number of diaphragms and the number of recesses on the rotor will produce different flow profiles of fluid through the pump.

For example, in all embodiments of the invention, a pump comprising one diaphragm will provide a pulsed fluid flow regardless of the number of fluid-conveying chambers, since there will be periods when no fluid is flowing from a fluid-conveying chamber to the fluid outlet port. A pump, in embodiments of the first aspect of the invention, comprising an equal number of diaphragms and fluid-conveying chambers both equidistantly spaced about the circumference of the cavity in which the rotor is located will also provide a pulsed fluid flow, for the same reason. A pump according to the first aspect of the invention comprising an even number of diaphragms and a plural odd number of fluid-conveying chambers will provide a continuous fluid flow. A pump according to the first aspect of the invention comprising a plural odd number of diaphragms and an even number of fluid-conveying chambers will provide a continuous fluid flow.

In an embodiment of the first aspect of the invention, the pump comprises two diaphragms, which are located equidistantly about the circumference of the cavity in which the rotor is located on diametrically opposite sides of the rotor, and the rotor has four surface recesses that form with said interior surface of the housing four fluid-conveying chambers that, on rotation of the rotor, convey fluid from the first fluid port to the second fluid port. Such an arrangement will provide a pulsed fluid flow.

In another embodiment of the first aspect of the invention, the pump comprises two diaphragms, which are located equidistantly about the circumference of the cavity in which the rotor is located on diametrically opposite sides of the rotor, and the rotor has three surface recesses that form with said interior surface of the housing three fluid-conveying chambers that, on rotation of the rotor, conveys fluid from the first fluid port to the second fluid port. Such an arrangement will provide a continuous fluid flow.

In another embodiment of the first aspect of the invention, the pump comprises two diaphragms, which are located equidistantly about the circumference of the cavity in which the rotor is located on diametrically opposite sides of the rotor, and the rotor has five surface recesses that form with said interior surface of the housing five fluid-conveying chambers that, on rotation of the rotor, conveys fluid from the first fluid port to the second fluid port. Such an arrangement will provide a continuous fluid flow with less fluctuation about the mean flow compared to a rotor carrying three recesses for a given rotor diameter and length.

In addition to improving the fluid flow profile through the pump, the presence of the flow channels also provides a cooling and lubricating effect to counteract the heat generated by the friction between the housing engaging surface area of the rotor and the interior surface of the housing.

Furthermore, the axially disposed fluid paths provided by the flow channels advantageously fills and/or empties the fluid-conveying chamber along its entire axial length, which enables faster and more efficient emptying of the fluid-conveying chamber. In addition, the first fluid port in communication with the first chamber can supply a plurality of first flow channels and the second chamber can combine the flow from a plurality of second flow channels to flow to the second fluid port, which means that a plurality of fluid-conveying chambers can be filled and/or emptied simultaneously improving the fluid throughput and the smoothing the flow profile. In addition, use of a first and/or second chamber enables the first fluid port and/or second fluid port to be located more flexibly on the pump housing.

In addition, the flow channels mean that in any orientation of the rotor, all cavities within the pump are open to a sterilising gas such as ethylene oxide or vapour hydrogen peroxide.

According to the first aspect of the invention, the first fluid port and the second fluid port can be in various locations relative to each other, provided all of the first flow channels are only in direct fluid flow communication with the first fluid port and all of the second flow channels are only in direct fluid flow communication with the second fluid port. For example, both of the first and second fluid ports may be axially aligned relative to the longitudinal axis of rotation of the rotor, or both of the first and second fluid ports may be radially aligned relative to the longitudinal axis of rotation of the rotor, or one of the first and second fluid ports may be axially aligned relative to the longitudinal axis of rotation of the rotor and the other of the first and second fluid ports may be radially aligned relative to the longitudinal axis of rotation of the rotor.

In one embodiment of first aspect of the invention, the first fluid port and the second fluid port are at opposite ends of the rotor. In an alternative embodiment of the first aspect of the invention, the first fluid port and the second fluid port are at the same end of the rotor. In an alternative embodiment of the first aspect of the invention, the first fluid port and the second fluid port are located in the region of the same end of the rotor. In an alternative embodiment of the first aspect of the invention, the first fluid port and the second fluid port are located in the region of opposite ends of the rotor.

When both the first fluid port and the second fluid part are radially aligned relative to the longitudinal axis of rotation of the rotor, the first fluid port and the second fluid port may be located on the same side of the rotor. Alternatively, the first fluid port and the second fluid port may be circumferentially spaced apart around the circumference of the rotor. Arranging each pair of flow channels such that the first fluid port is only in direct fluid flow communication with the first flow channels and the second fluid port is only in direct fluid flow communication with the second flow channels, advantageously allows the first fluid port and the second fluid port to be arranged in any number of different orientations.

In a preferred embodiment of the first aspect of the invention, the direction of rotation of the rotor is reversible. In a first direction, the first fluid port is a fluid inlet port and the second fluid port is a fluid outlet port. In the opposite direction the first fluid port is the fluid outlet port and the second fluid port is the fluid inlet port. When the direction of rotation is reversed, the first fluid port, the first chamber, if present, and the first flow channel(s) become the second fluid port, the second chamber and the second flow channel (s) and the second fluid port, the second chamber, if present, and the second flow channel(s) become the first fluid port, the first chamber and the first flow channel(s).

In a preferred embodiment of the second aspect of the invention, the direction of rotation of the rotor is reversible. When the direction of rotation is reversed, the first fluid port becomes the second fluid port, the second fluid port becomes the first fluid port, the first fluid port opens directly into the fluid-conveying chamber via the aperture and the fluid-conveying chamber empties into the flow channel, which is in fluid flow communication with the second fluid port.

The pressurising means of all aspects of the invention may comprise a fluid supplied to the rear surface of the resiliently deformable diaphragm and contained within a diaphragm chamber. The fluid providing the pressurising means may be provided by the fluid flowing through the pump, or may be supplied from a separate source.

If the fluid providing the pressurising means is provided from a separate source the fluid is suitably at higher pressure than the fluid flowing through the pump. In this embodiment, the second fluid may flow from the diaphragm chamber through a restricted orifice to mix with the fluid flowing through the pump in the flow of fluid passing through the second fluid port.

If fluid providing the pressurising means is provided by fluid flowing through the pump, a one-way valve may be located between the diaphragm chamber and the second fluid port. In this embodiment, if the direction of flow of the pump is reversed, the one-way valve will prevent fluid exiting the diaphragm chamber and the pressure on the rear surface of the diaphragm will be maintained.

Any suitable one-way valve may be used.

In using a pump of the first aspect of the present invention, fluid flows into the pump via the first fluid port and into the open end and open surface of the one or a plurality of first flow channels that are in direct fluid flow communication with the first fluid port. If a first chamber is present, the fluid flows into the first chamber before it flows into the first flow channels.

The fluid then flows along the one or plurality of first flow channels and from there passes via the open channel surface of the first flow channels into the one or more fluid-conveying chambers formed between the recessed surface of the rotor and the interior surface of the housing. The action of the pressurising means on the rear surface of the diaphragm flexes the diaphragm so that the rotor engaging surface of the diaphragm remains in contact with the surface of the rotor as it rotates, including the recessed surface of the rotor, thereby emptying the fluid from the fluid-conveying chamber into the one or plurality of second flow channels.

The fluid passes into the second flow channels via the open channel surface of the one or plurality of second flow channels.

The fluid then flows along the one or plurality of second flow channels to the second fluid port. If the pump comprises a second chamber, the fluid flows from the second flow channels into the second chamber and from there to the second fluid port.

Thus, the first flow channels are indirectly in fluid flow communication with the second flow channels and the second fluid port by the action of the rotor, but fluid does not flow directly from the first flow channel to the second fluid port because of the diaphragm. In addition, the rotor and the housing are arranged such that as the rotor rotates, there is always at least one of the lands extending longitudinally along the axial length of the rotor between the recesses, bisecting the first and second flow channels.

The fluid flow is caused by the action of the resiliently deformable diaphragm on the rotor surface. The diaphragm displacing the liquid from the fluid-conveying chamber formed in the rotor surface towards the second fluid port. The empty fluid-conveying chamber creates a void as it rotates which creates a partial vacuum that draws fluid in from the first fluid port as the rotor continues to rotate.

The second chamber may be provided by or be in fluid flow communication with each of the one or more diaphragm chambers surrounding the rear surface of one or all of the resiliently deformable diaphragms. Thus, fluid may flow from the second flow channels into a diaphragm chamber and from there to the second fluid port. An advantage of this arrangement is the fluid flowing through the pump provides fluid in contact with the rear of the resiliently deformable diaphragm and provides the or an additional pressurising means to urge the resiliently deformable diaphragm into contact with the surface of the rotor.

In using a pump of the second aspect of the present invention, fluid flows into the pump via the first fluid port and into the open end of the flow channel. The fluid then flows along the flow channel and passes via the open channel surface into a fluid-conveying chamber formed between the recessed surface of the rotor and the interior surface of the housing. The action of the pressurising means on the rear surface of the diaphragm flexes the diaphragm so that the rotor engaging surface of the diaphragm remains in contact with the surface of the rotor as it rotates, including the recessed surface of the rotor, thereby emptying the fluid from the fluid-conveying chamber through the aperture and into the second fluid port.

The following is a more detailed description of embodiments of the invention, provided by way of example only, reference being made to the accompanying drawings, in which.

Figure 6:
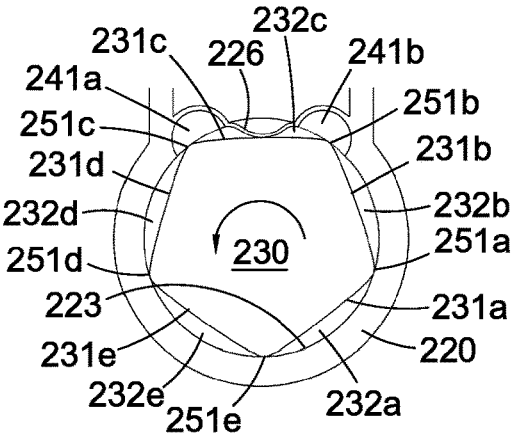
Figure 7:
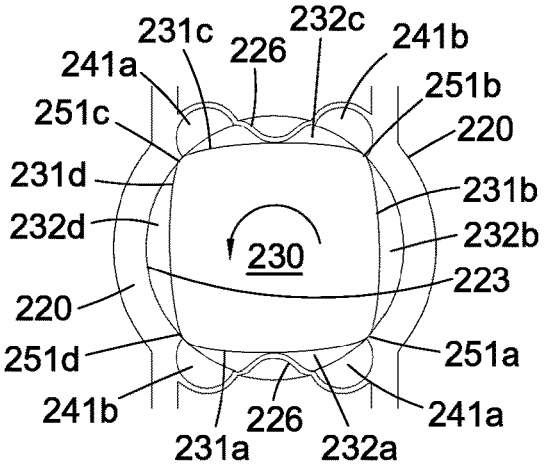
Figure 8:
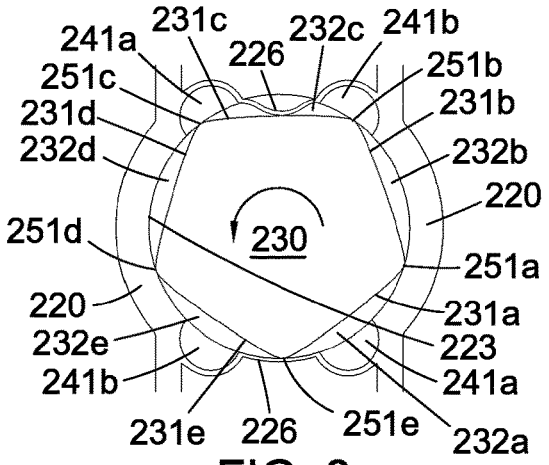
Figure 11:
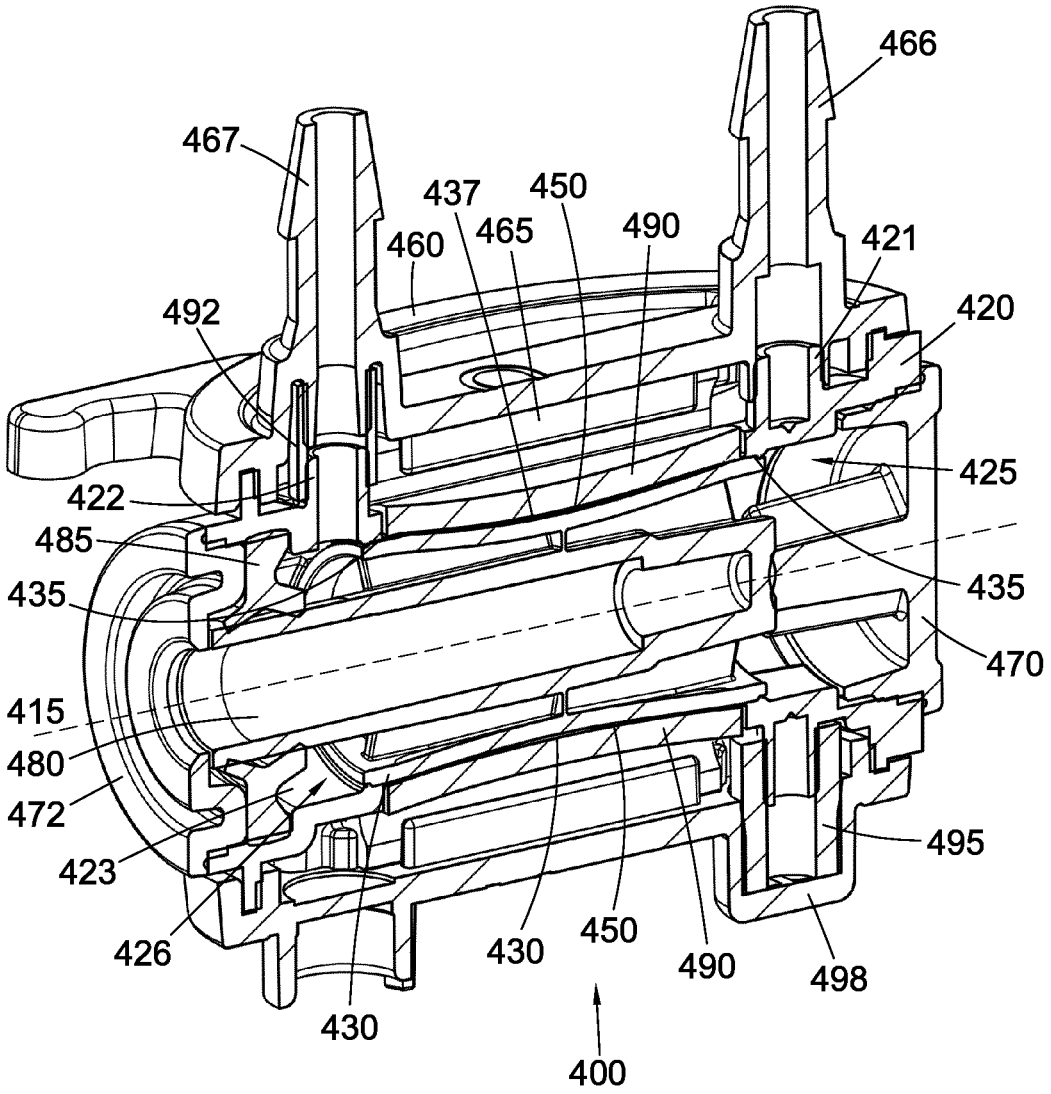
Figure 12:
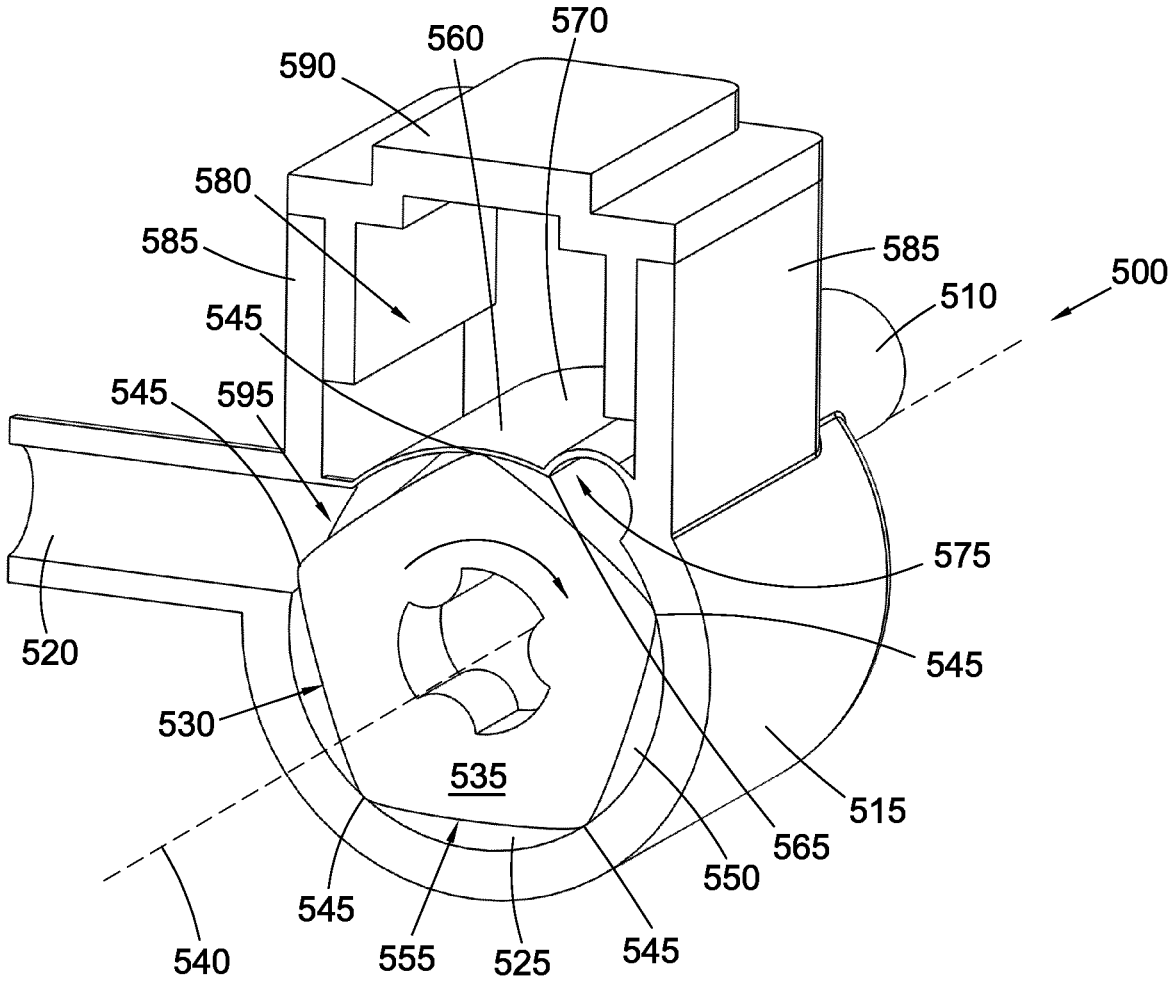
Figure 13:
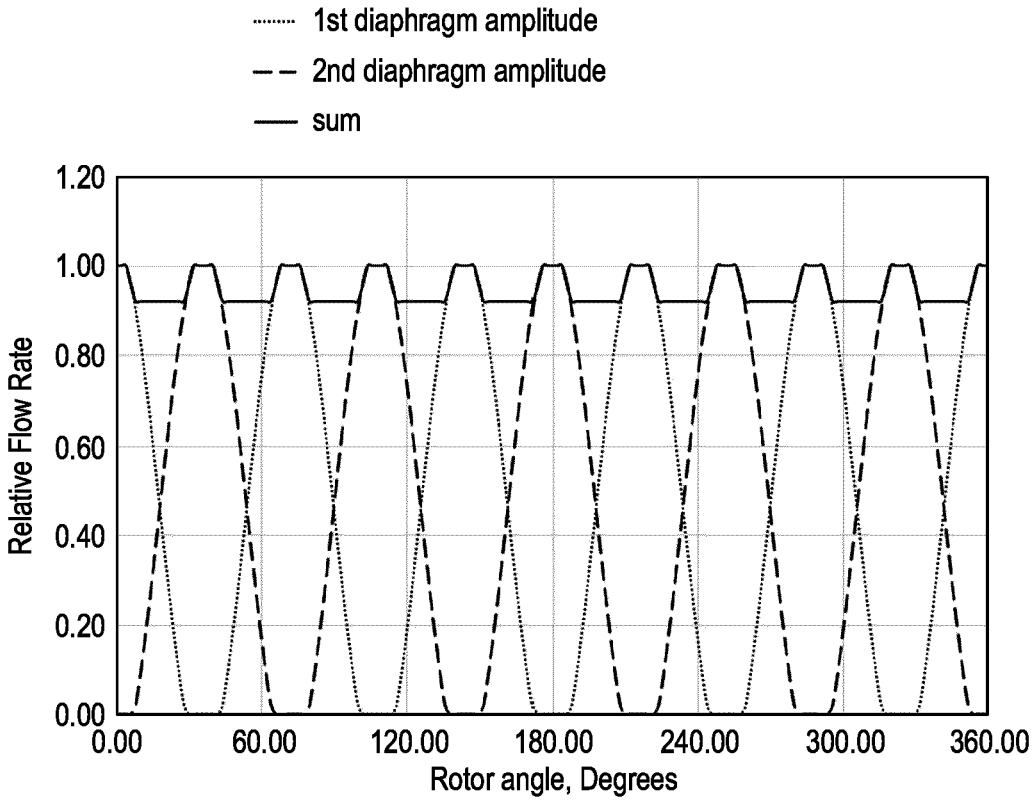
Figure 14:
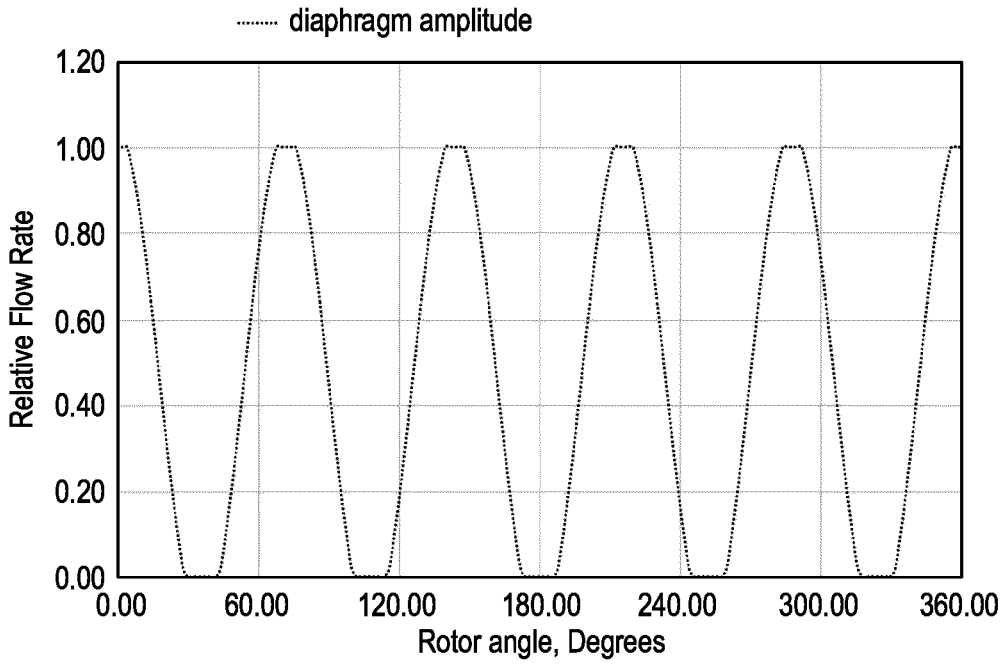
Figure 15:
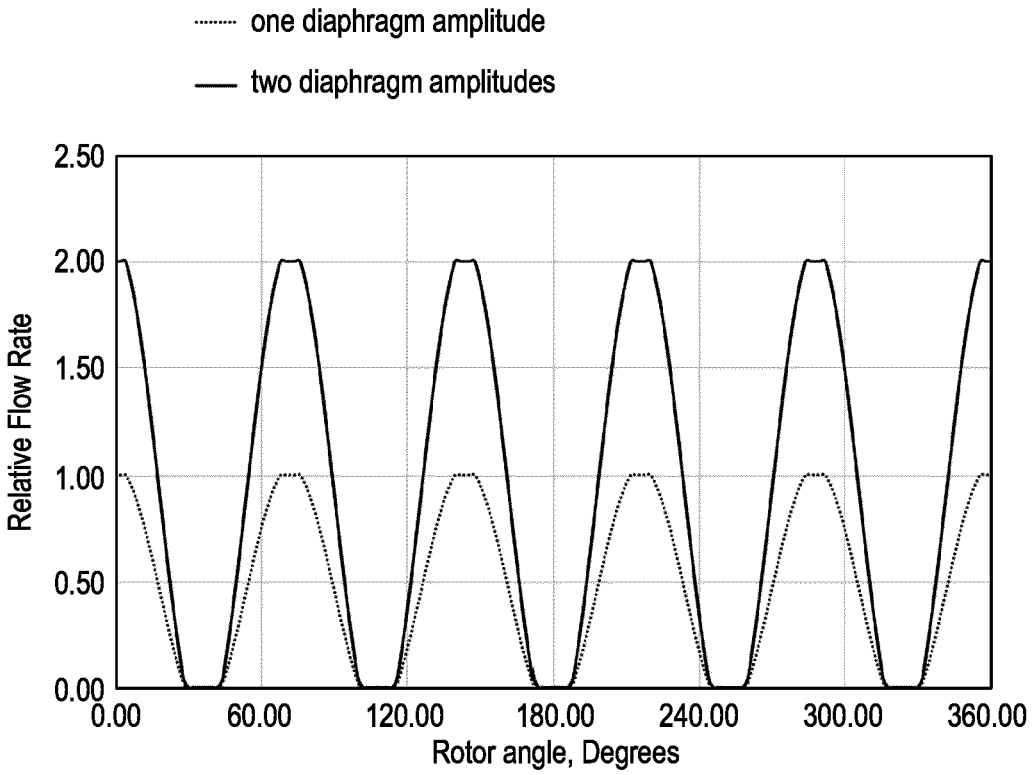

FIG. 11 is a schematic cross-sectional view of a pump according to a third embodiment of the first aspect of the invention, FIG. 12 is a schematic, cross-sectional view of a pump according to the second aspect of the invention, FIG. 13 illustrates the displacement through a pump having an arrangement of diaphragms and rotor chambers as shown in FIG. 8, FIG. 14 illustrates the displacement through a pump having an arrangement of diaphragms and rotor chambers as shown in FIG. 6, and FIG. 15 illustrates the displacement through a pump having an arrangement of diaphragms and rotor chambers as shown in FIG. 7.

Figure 1:
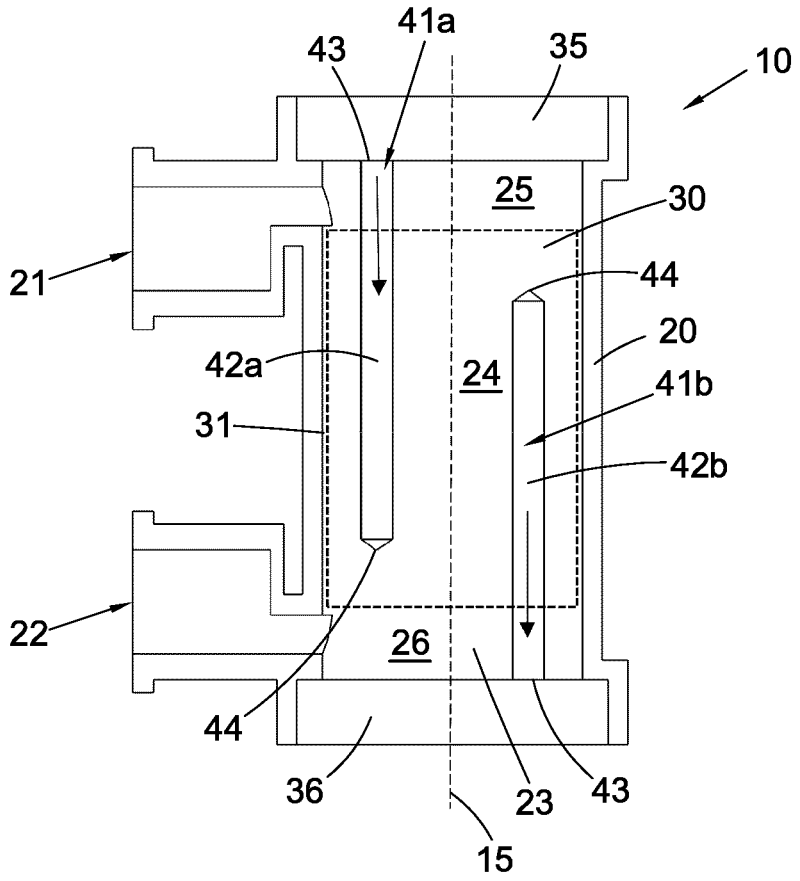
FIG. 1 is a schematic cross-sectional view of a pump according to a first embodiment of the first aspect of the invention.

FIG. 1, shows a pump 10 comprises a housing 20 with a first fluid port providing an inlet port 21 and a second fluid port providing an outlet port 22. The housing 20 has an interior surface 23, defining a cavity generally indicated by reference numeral 24, within which a rotor 30 (generally indicated in dashed lines) is located. In this figure, orientation of the rotor 30 is such that the recesses on the surface of the rotor 30 are not illustrated. However, the general location of the rotor 30 within the cavity 24 is shown to indicate that the housing engaging surface area 31 of the rotor 30 is in contact with the interior surface 23 of the housing 20 to provide a sealing, interference fit. The longitudinal axis of rotation of the rotor is also indicated by dashed line 15. As can be seen from FIG. 1, both of the first and second fluid port are radially aligned relative to the longitudinal axis of rotation of the rotor (15).

A first chamber 25 is formed between the interior surface 23 of the housing 20 and the end of the rotor 30 adjacent the inlet port 21. FIG. 1 also shows a pair of flow channels 41*a*, 41*b*, which are formed as recessed channels in the interior surface 23 of the housing that defines the cavity 24 in which the rotor 30 is located. A first flow channel 41*a* opens into the first chamber 25. A second chamber 26 is formed between the interior surface 23 of the housing 20 and the opposite end of the rotor 30 adjacent the outlet port 22. A second flow channel 41*b* opens into the second chamber 26. It can be seen from FIG. 1 that the first flow channel 41*a* does not open into the second chamber 26 and the second flow channel 41*b* does not open into the first chamber 25.

The first and second chambers 25 and 26 are each separately completed by endcaps 35 and 36, respectively. One of these endcaps 35, 36 is a lip seal (not shown) or a cap carrying a lip seal (not shown) through which lip seal a shaft (not shown) on which rotor 30 is mounted passes to engage the rotor with a drive means.

When the rotor 30 is located within the cavity 24 of the housing 20, the longitudinal open channel surfaces 42*a*, 42*b* of the flow channels 41*a*, 41*b* extend along the surface of the rotor 30 and are in fluid flow communication with the surface of the rotor 30.

As illustrated in FIG. 1, each flow channel 41*a*, 41*b* has an open end 43 and a closed end 44. With the open end 43 and the closed end 44 of each channel 41*a*, 41*b* in a pair of channels being at opposing ends of the channels 41*a*, 41*b*. It can be seen that the open end 43 of the first flow channel 41*a* is in direct fluid flow communication with the fluid inlet port 21 and the open end 43 of the second flow channel 41*b* is in direct fluid flow communication with the fluid outlet port 22. It can also be seen from FIG. 1 that the second channel 41*b* is not in direct fluid flow communication with the fluid inlet 21 port and the first channel 41*a* is not in direct fluid flow communication with the fluid outlet port 22.

Figure 2:
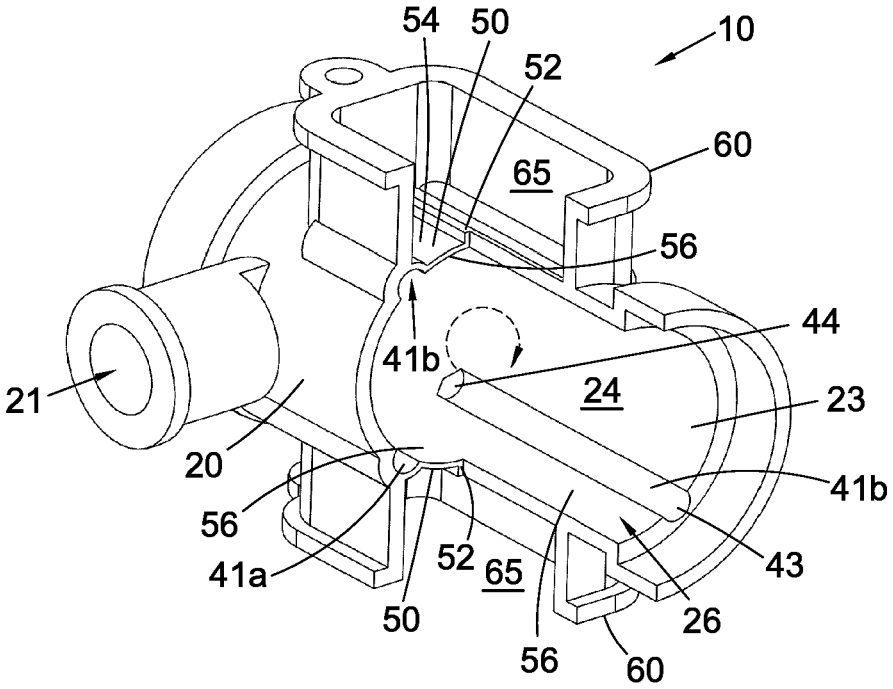
FIG. 2 is a cutaway perspective view of the pump of FIG. 1.
Figure 3:
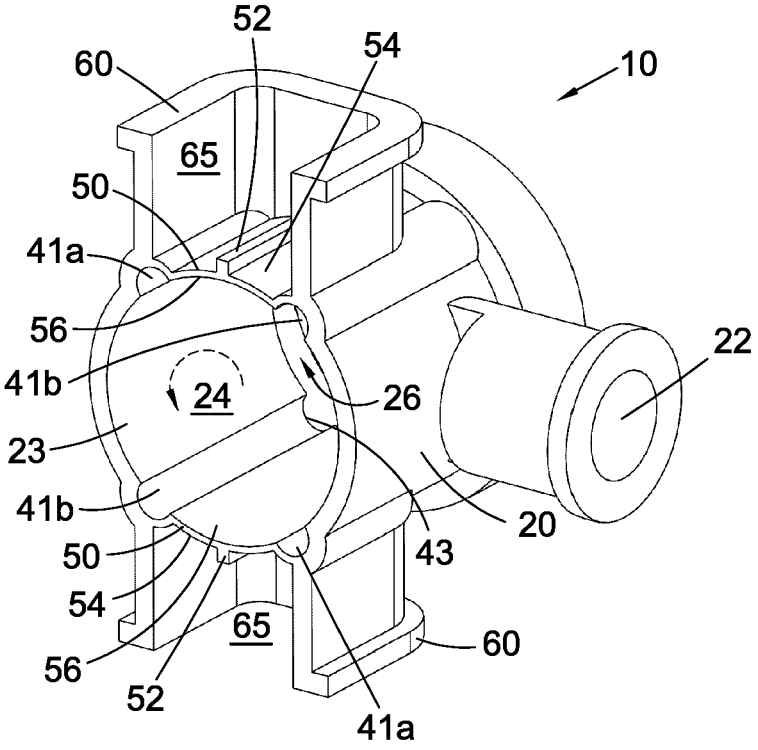
FIG. 3 is a partial cutaway alternative perspective view of the embodiment of FIGS. 1 and 2.

Although FIG. 1 only shows one pair of flow channels 41*a*, 41*b*, it can be seen from FIGS. 2 and 3 that the pump comprises two pairs of flow channels 41*a*, 41*b*. The open end 43 of each of the first channels 41*a* in both pairs of flow channels would be in direct fluid flow communication with the fluid inlet port 21 and the open end 43 of each of the second channels 41*b* in both pairs of flow channels would be in direct fluid flow communication with the fluid outlet port 22.

The housing 20 may be formed from a plastics material and may be made by any suitable moulding process. For example, the housing may be made from a thermoplastic such as polypropylene, polyethylene, thermoplastic polyurethane (TPU), thermoplastic elastomers (TPE), or a thermoset such as silicone rubber. Preferably, the housing is resilient. Preferably, the housing is made in a one-shot moulding process.

The rotor (not shown) may be made from a rigid material such as stainless steel, polyether ether ketone (PEEK), HDPE or polycarbonate.

The fluid inlet port 21 and the fluid outlet port 22 in this embodiment of the invention are both located on the side of the pump 10, in other words the fluid inlet port 21 and the fluid outlet port 22 are both located radially of the longitudinal axis of rotation 15 of the rotor (not shown). Whilst they are shown as being on the same side of the housing 20, they could each be arranged anywhere about the circumference of the housing 20. In an alternative arrangement (not shown), the fluid inlet port 21 and the fluid outlet port 22 could be arranged at the same or opposite ends of the housing, in such an embodiment the inlet or outlet port 21, 22 may be formed in the endcaps 35, 36. In a further alternative (not shown), one of the inlet or outlet ports 21, 22 could be arranged about the circumference of the housing, providing a radial port, and the other of the inlet or outlet ports 21, 22 could be arranged at an end of the housing providing an axial port.

In use, fluid flows into the pump 10 via the fluid inlet port 21 and into the first chamber 25. From the first chamber 25, fluid flows into the open surface of the first flow channel 41*a*. The fluid flows along the first flow channel 41*a* in the direction shown by the arrow. Rotation of the rotor 30 brings a fluid-conveying chamber (not shown) formed by a recess (not shown) on the rotor 30 and the interior surface 23 of the housing, into fluid flow communication with the open surface of the first flow channel 41*a*. Fluid flows from the first flow channel 41*a* into the fluid-conveying chamber. Continued rotation of the rotor moves the fluid away from the first flow channel 41*a* and into fluid flow communication with the open surface of the second flow channel 41*b*. Fluid flows from the fluid-conveying chamber and into the open surface of the second flow channel 41*b*, assisted by the resiliently deformable diaphragm (not shown in FIG. 1), which displaces the fluid from the fluid-conveying chamber into the second flow channel 41*b*. Fluid flows along the second flow channel 41*b* in the direction shown by the arrow into the second chamber 26. Fluid flows from the second chamber out of the pump via the fluid outlet port 22.

FIGS. 2 and 3 illustrate an alternative view of the pump shown in FIG. 1. FIG. 2 is a partial cutaway section of one end of the pump, showing a first fluid port providing an inlet port 21, but omitting a second fluid port 22. FIG. 3 is a partial cut-away view of the other end of the pump shown in FIG. 2, this time showing the second fluid port providing a fluid outlet port 22, turned around to show the inside of the housing.

In this view of the embodiment two pairs of flow channels 41*a*, 41*b* can be seen. The first flow channels 41*a* open into the first chamber (not shown). A second chamber 26 is formed between the interior surface 23 of the housing 20 and the end of the rotor (not shown). The second flow channels 41*b* open into the second chamber 26. It can be seen from FIG. 2 that the second flow channel 41*b* does not open into the first chamber (not shown).

FIGS. 2 and 3 show that the pairs of flow channels 41*a*, 41*b*, are formed as recessed channels in the interior surface 23 of the housing 20. The pairs of flow channels 41*a*, 41*b* are formed in the interior surface 23 that defines the cavity 24 in which the rotor (not shown) is located in use.

FIGS. 2 and 3 also show two resiliently deformable diaphragms 50. It can be seen that the two resiliently deformable diaphragms 50 are unitary with the housing 20 and are provided by a section of the interior surface 23 of the housing 20 that is thinner and thus more flexible than the rest of the housing 20. Furthermore, it can be seen from FIGS. 2 and 3, that the two resiliently deformable diaphragms 50 comprise a rib 52 on a rear surface 54 of each of the two resiliently deformable diaphragms 50. Each of the two resiliently deformable diaphragms 50 comprise a rotor engaging surface 56. Furthermore, FIGS. 2 and 3 show a wall 60 extending from the housing, forming a diaphragm chamber 65 surrounding the rear surface 54 of each diaphragm 50. The wall 60 may be closed with a cap (not shown) to form an enclosed diaphragm chamber 65 around the rear surface 54 of each diaphragm 50. Pressurising means (not shown) can be locating inside the diaphragm chamber 65 to urge the diaphragm 50 against the rotor (not shown).

As illustrated in FIGS. 2 and 3, the second flow channel 41*b* has an open end 43 and a closed end 44. The open end 43 of the second channel 41*b* is in direct fluid flow communication with the fluid outlet port 22 and the second channel 41*b* is not in direct fluid flow communication with the fluid inlet port 21.

It can also be seen from FIGS. 2 and 3 that each pair of flow channels 41*a*, 41*b* extends along the longitudinal side of each resiliently deformable diaphragm 50. Each flow channel 41*a*, 41*b* is formed adjacent the side edge of the diaphragm 50 and may be partially or wholly formed in the diaphragm 50. Each pair of flow channels 41*b*, 41*b* would be essentially parallel with the axis of rotation of the rotor (not shown in FIGS. 2 and 3) when the rotor is inserted into the cavity 24 for use. Furthermore, each flow channel 41*a*, 41*b* is essentially parallel to the other flow channels 41*a*, 41*b*.

In use, as the rotor is rotated in a clockwise direction (as indicated in FIG. 2) fluid flows into the pump through inlet port 21 into a first chamber (not shown) and from there into the first flow channels 41*a*. The fluid-conveying chamber formed between the rotor recess and the interior surface of the housing 23 is filled by fluid from the flow channels 41*a*. Continued rotation of the rotor moves the fluid-conveying chamber full of fluid to a position where it is open to a second flow channel 41*b*. The action of the flexible diaphragm 50 on the surface of the rotor (not shown) displaces the fluid from the fluid-conveying chamber into a second flow channel 41*b*. The fluid passes from the second flow channel 41*b* into the second chamber 26 and from there through the outlet port 22.

FIGS. 4 to 9 show cross-sectional views of different arrangements of diaphragm and rotor. For ease of reference, like reference numerals are used for like features in FIGS. 4 to 9.

Figure 4:
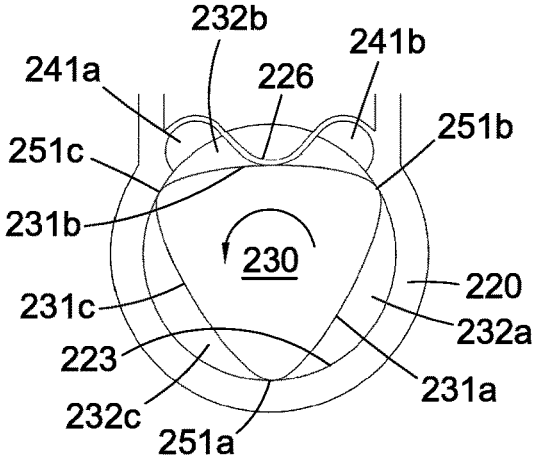
FIGS. 4 to 9 show different variations of diaphragm and rotor recess combinations.

FIG. 4 shows part of a housing 220 comprising one resiliently deformable diaphragm 226 formed as a unitary arrangement by a thinner section of the housing 220. The resiliently deformable diaphragm 226 extends between a first flow channel 241*a* and a second flow channel 241*b*. The rotor 230 comprises three recesses 231*a*, 231*b*, 231*c* which form three fluid-conveying chambers 232*a*, 232*b*, 232*c* with the interior surface 223 of the housing 220. The rotor also has three lands 251*a*, 251*b* and 251*c* between the recesses, which provide housing engaging surface areas forming a sealing interference fit with the interior surface of the housing. In this figure, the diaphragm 226 is urged into contact with the recessed surface 231*b* of the rotor 230 by pressurising means (not shown) and is displacing the fluid from the fluid-conveying chamber 232*b* into the second channel flow 241*b* as the rotor rotates anti-clockwise. At the same time, a partial vacuum is created in the part of the recess 231*b* that has passed the diaphragm 226 and fluid is sucked in from first flow channel 241*a* to refill chamber 232*b* as the rotor 230) continues to rotate. In use this arrangement of diaphragm and rotor will produce a pulsed flow of fluid, with periods of substantially no fluid flowing out of the outlet port.

Figure 5:
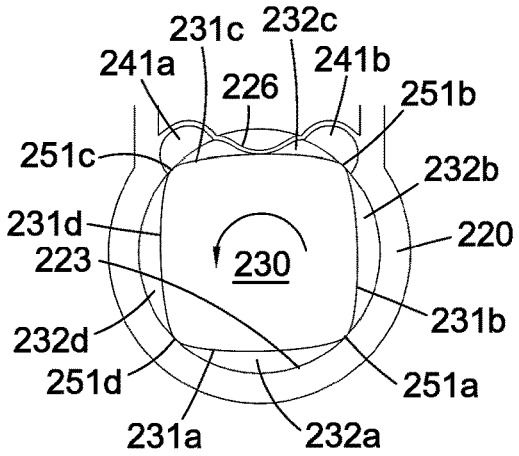

FIG. 5 shows part of a housing 220 comprising one resiliently deformable diaphragm 226 formed as a unitary arrangement by a thinner section of the housing 220. The resiliently deformable diaphragm 226 extends between a first flow channel 241*a* and a second flow channel 241*b*. The rotor 230 comprises four recesses 231*a*, 231*b*, 231*c*, 231*d* which form four rotor chambers 232*a*, 232*b*, 232*c*, 232*d* with the interior surface 223 of the housing 220. The rotor also has four lands 251*a*. 251*b*, 251*c* and 251*d* between the recesses, which provide housing engaging surface areas forming a sealing interference fit with the interior surface of the housing. In this figure, the diaphragm 226 is urged into contact with the recessed surface 231*c* of the rotor 230 by pressurising means (not shown) and is displacing the fluid from the fluid-conveying chamber 232*c* into the second flow channel 241*b* as the rotor rotates anti-clockwise. At the same time, a partial vacuum is created in the part of the recess 231*c* that has passed the diaphragm 226 and fluid is sucked in from first flow channel 241*a* to refill chamber 232*c* as the rotor 230 continues to rotate. In use this arrangement of diaphragm and rotor will produce a pulsed flow of fluid, with periods of substantially no fluid flowing out of the outlet port.

FIG. 6 shows part of a housing 220 comprising one resiliently deformable diaphragm 226 formed as a unitary arrangement by a thinner section of the housing 220. The resiliently deformable diaphragm 226 extends between a first flow channel 241*a* and a second flow channel 241*b*. The rotor 230 comprises five recesses 231*a*, 231*b*, 231*c*, 231*d*, 231*e* which form five rotor chambers 232*a*, 232*b*, 232*c*, 232*d*, 232*e* with the interior surface 223 of the housing 220. The rotor also has five lands 251*a*, 251*b*, 251*c*. 251*d* and 251*e* between the recesses, which provide housing engaging surface areas forming a sealing interference fit with the interior surface of the housing. In this figure, the diaphragm 226 is urged into contact with the recessed surface 231*c* of the rotor 230 by pressurising means (not shown) and is displacing the fluid from the fluid-conveying chamber 232*c* into the second flow channel 241*b* as the rotor rotates anti-clockwise. At the same time, a partial vacuum is created in the part of the recess 231*c* that has passed the diaphragm 226 and fluid is sucked in from first flow channel 241*a* to refill chamber 232*c* as the rotor 230 continues to rotate. In use this arrangement of diaphragm and rotor will produce a pulsed flow of fluid, with periods of substantially no fluid flowing out of the outlet port.

The flow through a pump comprising the rotor and diaphragm combination of FIG. 6 is further illustrated in FIG. 14. FIG. 14 illustrates the displacement of the diaphragm 226 as the rotor 230 rotates. The flow rate of fluid through the pump is the area under the graph. It can be seen that that the fluid flow is pulsed with periods of zero flow. Since there is only one diaphragm in the arrangement of FIG. 6, only one fluid-conveying chamber can empty at any one time, resulting in the pulsed fluid output from the pump.

FIG. 7 shows part of a housing 220 comprising two resiliently deformable diaphragms 226 formed as a unitary arrangement by a thinner section of the housing 220. The resiliently deformable diaphragms 226 are arranged diametrically opposite one another and each extend between a first flow channel 241*a* and a second flow channel 241*b*. Thus, the housing 220 comprise two pairs of flow channels 241*a*, 241*b*, each pair being associated with one diaphragm 226. The first flow channels 241*a* and the second flow channels 241*b* being alternatively arranged about the circumference of the rotor. The rotor 230 comprises four recesses 231*a*, 231*b*, 231*c*, 231*d* which form four rotor chambers 232*a*, 232*b*, 232*c*, 232*d* with the interior surface 223 of the housing 220. The rotor also has four lands 251*a*, 251*b*, 251*c* and 251*d* between the recesses, which provide housing engaging surface areas forming a sealing interference fit with the interior surface of the housing. In this figure, the diaphragms 226 are urged into contact with the recessed surfaces 231*a* and 231*c* of the rotor 230 by pressurising means (not shown) and are displacing the fluid from the fluid-conveying chambers 232*a* and 232*c* into the second channel flows 241*b* as the rotor rotates anti-clockwise. In use this arrangement of diaphragm and rotor will produce a pulsed flow of fluid, which periods of substantially no fluid flowing out of the outlet port. The presence of two diaphragms means the flow rate is doubled because the rotor chambers are being emptied twice per revolution of the rotor.

The flow through a pump comprising the rotor and diaphragm combination of FIG. 7 is further illustrated in FIG. 15. FIG. 15 illustrates the displacement of the diaphragm 226 as the rotor 230 rotates. The flow rate of fluid through the pump is the area under the graph. Again, it can be seen that that fluid is pulsed with periods of zero flow. In this embodiment, there are two diaphragms, so two fluid-conveying chambers emptying. However, since the rotor comprises an even number of recesses equidistantly spaced about the rotor and the diaphragm are diametrically opposite one another, the fluid chambers that are emptied by each diaphragm are emptied concurrently. This can be seen in the graph of FIG. 15 because the two sinusoidal waves are superimposed, resulting in a larger wave amplitude, but still having periods of zero flow:

FIG. 8 shows part of a housing 220 comprising two resiliently deformable diaphragms 226 formed as a unitary arrangement by a thinner section of the housing 220. The resiliently deformable diaphragms 226 each extend between a first flow channel 241*a* and a second flow channel 241*b*. Thus, the pump 220 comprise two pairs of flow channels 241*a*, 241*b*. The rotor 230 comprises five recesses 231*a*, 231*b*, 231*c*, 231*d*, 231*e* which form five rotor chambers 232*a*. 232*b*, 232*c*, 232*d*, 232*e* with the interior surface 223 of the housing 220. The rotor also has five lands 251*a*, 251*b*, 251*c*, 251*d* and 251*e* between the recesses, which provide housing engaging surface areas forming a sealing interference fit with the interior surface of the housing. In this figure, one of the diaphragms 226 is urged into contact with the recessed surface 231*c* of the rotor 230 by pressurising means (not shown) and is displacing the fluid from the fluid-conveying chamber 232*c* into the second channel flow 241*b* as the rotor rotates anti-clockwise. At the same time, the part of the chamber 232*c* that has passed the diaphragm 226 comprises a partial vacuum which causes fluid to be drawn into this part of the chamber 232*c* from first flow channel 241*a*. Thus, the chamber 232*c* is emptied and refilled by the action of the diaphragm 226 on the recessed surface of the rotor as the chamber moves past the diaphragm as the rotor rotates. At the same time the other diaphragm 226 is separating the other pair of flow channels 241*b* and 241*a* as it contacts the land 251*e*.

The flow through a pump comprising the rotor and diaphragm combination of FIG. 8 is further illustrated in FIG. 13. FIG. 13 illustrates the displacement of the diaphragm 226 as the rotor 230 rotates. The flow rate of fluid through the pump is the area under the graph. Again, it can be seen that that fluid flow from each diaphragm is pulsed with periods of zero flow. However, because in this embodiment there are two diaphragms, and the rotor comprises an odd number of recesses equidistantly spaced about the rotor, the fluid chambers that are emptied by each diaphragm are emptied at different times at any constant rotor speed. This can be seen in the graph of FIG. 15 because the two sinusoidal waves representing the displacement of the two different diaphragms are not coincedential, resulting in a continuous flow of fluid from the pump. It can be seen that the flow rate does vary, but while the pump is operational, there is always some fluid flowing from the pump.

Figure 9:
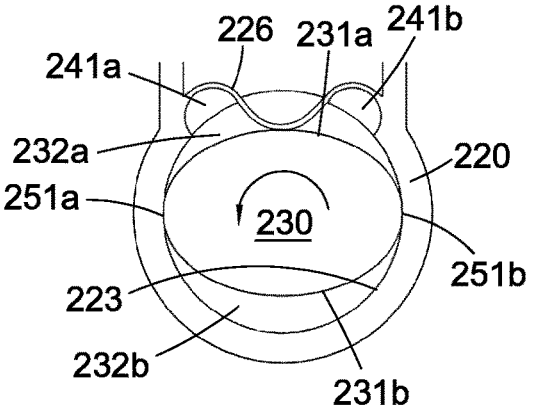

FIG. 9 shows part of a housing 220 comprising one resiliently deformable diaphragm 226 formed as a unitary arrangement by a thinner section of the housing 220. The resiliently deformable diaphragm 226 extends between a first flow channel 241*a* and a second flow channel 241*b*. The rotor 230 comprises two recesses 231*a* and 231*b*, which form two rotor chambers 232*a* and 232*b* with the interior surface 223 of the housing 220. The rotor also has two lands 251*a* and 251*b* between the recesses, which provide housing engaging surface areas forming a sealing interference fit with the interior surface of the housing. In this figure, the diaphragm 226 is urged into contact with the recessed surface 231*a* of the rotor 230 by pressurising means (not shown) and is displacing the fluid from the fluid-conveying chamber 232*a* into the second flow channel 241*b* as the rotor rotates anti-clockwise. At the same time, a partial vacuum is created as the part of the recess 231*a* that has passed the diaphragm 226 and fluid is sucked in from first flow channel 241*a* to refill chamber 232*a* as the rotor 230 continues to rotate. In use this arrangement of diaphragm and rotor will produce a pulsed flow of fluid, with periods of substantially no fluid flowing out of the outlet port.

Figure 10:
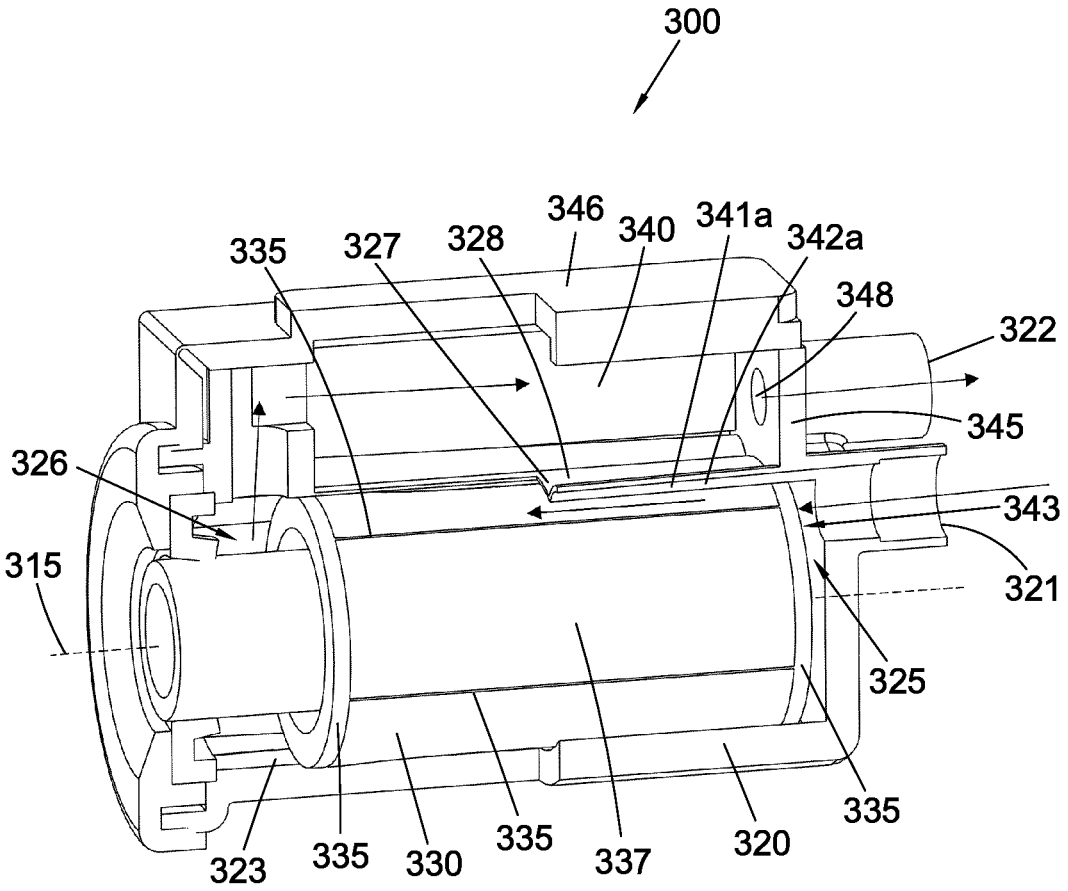
FIG. 10 is a schematic cutaway side view of a pump according to a second embodiment of the first aspect of the invention.

FIG. 10, shows a pump 300 comprises a housing 320 with a first fluid port providing an inlet port 321 and a second fluid port providing an outlet port 322. Both the inlet port 321 and the outlet port 322 are axially aligned relative to the longitudinal axis of rotation 315 of the rotor 330. In this embodiment, both the inlet port 321 and the outlet port 322 are at the same end of the housing and rotor. The housing 320 has an interior surface 323, within which a rotor 330 is located. In this figure, the orientation of the rotor 330 is such that the depth of the recesses on the surface of the rotor 330 are not fully illustrated. The rotor 330 comprises a plurality of housing engaging surfaces 335 and a plurality of recesses 337. Each recess 337 forms a fluid-conveying chamber with the interior surface 323 of the housing 320. The housing engaging surface areas 335 of the rotor 330 are in contact with the interior surface 323 of the housing 320 to provide a sealing, interference fit. The longitudinal axis of rotation of the rotor 330 is indicated by dashed line 315.

A first chamber 325 is formed between the interior surface 323 of the housing 320 and the end of the rotor 330. A first flow channel 341*a* opens into the first chamber 325. A second chamber 326 is formed between the interior surface 323 of the housing 320 and the end of opposite end of the rotor 330. A second flow channel (not shown) opens into the second chamber 326. In this embodiment of the invention, the pump 300 further comprises a diaphragm chamber 340, formed on an exterior surface of the housing 320. The diaphragm chamber 340 surrounds the rear surface 327 of the diaphragm 328. The diaphragm chamber 340 comprises a side wall 345 extended from the housing 320 and unitary with the housing 320, and a separate closure member 346. The diaphragm chamber 340 is in fluid flow communication with the second chamber 326 and the fluid outlet port 322.

FIG. 10 also shows part of a first flow channel 341*a*, which is formed as a recessed channel in the interior surface 323 of the housing. As can be seen from FIG. 10, the first flow channel 341*a* is formed in the interior surface 323 that defines the cavity in which the rotor 330 is located. When the rotor 330 is located within the cavity of the housing 320, the longitudinal open channel surface 342*a* of the first flow channel 341*a* extends along the surface of the rotor 330 and is in fluid flow communication with the surface of the rotor 330.

The first flow channel 341*a* has an open end 343 in direct fluid flow communication with the fluid inlet port 321.

The fluid inlet port 321 and the fluid outlet port 322 in this embodiment of the invention are both located on the same end the pump 310.

In use, fluid flows into the pump 300 via the fluid inlet port 321 and into the first chamber 325. From the first chamber 325, fluid flows into the open surface of the first flow channel 341*a*. The fluid flows along the first flow channel 341*a* in the direction shown by the arrow. Rotation of the rotor 330 about the longitudinal axis of rotation 315 brings the fluid-conveying chamber formed by the recess 337 on the rotor 330 and the interior surface 323 of the housing, into fluid flow communication with the open surface of the first flow channel 341*a*. Fluid flows from the first flow channels 341*a* into the fluid-conveying chamber. Continued rotation of the rotor 330 moves the fluid, contained within a fixed volume described by the rotor chamber 337 and the interior surface 323 of the housing, away from the first flow channel 341*a* and, upon continued rotation of the rotor, into fluid flow communication with an open surface of a second flow channel (not shown). Thus, fluid flows from the fluid-conveying chamber into the open surface of the second flow channel assisted by the displacing action of the diaphragm 328. Fluid flows along the second flow channel (not shown) into the second chamber 326. Fluid flows from the second chamber 326 in the direction shown by the arrow into the diaphragm chamber 340. The pressure of the fluid in the diaphragm chamber 340 acts on the rear surface 327 of the diaphragm 328 to urge the diaphragm 328 against the rotor 330. The fluid continues to flow through the diaphragm chamber 340 in the direction shown by the arrow and exits the diaphragm chamber 340, in the direction shown by the arrow; through a passage 348 to exit the pump via the fluid outlet port 322.

FIG. 11 shows a cross-section view of an alternative embodiment of the present invention provided by pump 400. Pump 400 comprises a housing 420 comprising first fluid port providing an inlet port 421 and a second fluid port providing an outlet port 422 and an interior surface 423 defining a cavity in which the rotor 430 is located. The rotor 430 is located within the housing cavity and has housing engaging surfaces 435 which form an interference fit with the interior surface 423 of the housing 420. The rotor 430 comprises a plurality of recesses 437, which form fluid-conveying chambers (not shown) with the interior surface 423 of the housing. The housing 420 further comprises two resiliently deformable diaphragms 450 formed by thinner sections of the housing 420. A rotor engaging surface of each diaphragm 450 being urged into contact with the rotor 430 by means of pressuring means 490. The flow channels cannot be seen on this figure.

The pump 400 further comprises a first chamber 425 in fluid flow communication with the fluid inlet 421 and the first flow channels (not shown). The pump 400 further comprises a second chamber 426 in fluid flow with the second flow channels (not shown) and the fluid outlet 422.

FIG. 11 shows that the pump comprises an end cap 470 closing the pump at the end adjacent the first chamber 425 and an end cap 472 closing the pump at the end adjacent the second chamber 426. The second end cap 472 comprises an opening therein, to allow the shaft 480 of the rotor 430 to be connected to a motor drive shaft (not shown). A fluid tight fit is provided between the second end cap 472 and the shaft 480 of the rotor 430 by means of a lip seal 485.

FIG. 11 further illustrates a diaphragm cap 460, which is fitted onto the exterior of the housing to provide a diaphragm chamber 465, which surrounds the rear of the diaphragm 450 and contains the pressurising means 490. In this embodiment, the diaphragm cap 460 further comprises connectors 466 and 467 which fit over the fluid inlet 421 and fluid outlet 422, respectively, of the housing to facilitate connection of the pump 400 for use. In an alternative embodiment, the fluid inlet 421 and the fluid outlet 422 are longer and extend through the diaphragm cap 460 obviating the need for the connectors 466, 467.

The embodiment illustrated in FIG. 11 further illustrates a one-way valve 492 located between the fluid outlet 422 and the diaphragm chamber 465. Also illustrated is an optional pressure release valve 495 located between the diaphragm chamber 465 and the first chamber 425. Where such optional valve is fitted the blind hole 498 in the housing (as illustrated) is formed as a through hole.

In use of the pump of FIG. 11, fluid flows into the pump 400 via the connector 466 and the fluid inlet port 421, into the first chamber 425. Fluid flows from the first chamber into the first flow channels (not shown) and into the fluid-conveying chambers (not shown) formed between the recessed surfaces 437 of the rotor 430 and the interior surface of the housing 423. The fluid is conveyed around the pump as the rotor rotates and is displaced into the adjacent second flow channel (not shown) by the action of the diaphragm 450, which is urged against the surface of the rotor 430 by the pressurising means 490.

The fluid flows from the second channels (not shown) into the second chamber 426 and into the fluid outlet port 422. Some of the fluid will then flow out of the pump through the connector 467. Some of the fluid will flow past the one-way valve 492 into the diaphragm chamber 465. The fluid in the diaphragm chamber will apply further pressure to the rear surface of the diaphragm 450. Should the flow of liquid through the pump cease or the direction of flow of fluid through the pump 400 be reversed, the fluid shall be retained in the diaphragm chamber 465 by the one-way valve 492.

Should the pressure in the diaphragm chamber 465 become too high, fluid will force itself past the pressure release valve 495 and recirculate into the first chamber 425.

FIG. 12 illustrates an example of a pump 500, according to the second aspect of the invention. Pump 500 comprises a first fluid port 510 and a second fluid port 520, providing in this embodiment a fluid inlet and a fluid outlet, respectively. The pump 500 further comprises a housing 515 having an interior surface 525 defining a cavity 530 in which a rotor 535 is located, the rotor 535 having a longitudinal axis of rotation 540, and comprising, a plurality of housing engaging surface areas 545, some of which are shown in FIG. 12, forming a sealing interference fit with the interior surface 525 of the housing 515. The rotor 535 shown in this embodiment has five surface recesses 550 that form with the interior surface 525 of the housing five fluid-conveying chambers 555. The housing 515 comprises a resiliently deformable diaphragm 560) providing part of the interior surface 525 of the housing, being provided as a unit with the housing 515 by a thinner section of the housing 515. The diaphragm has a rotor engaging surface 565 and a rear surface 570 opposite the rotor engaging surface. The pump 500 further comprises a flow channel 575 being associated with the resiliently deformable diaphragm 560, the flow channel extending longitudinally from one end of the rotor 535 to overlie the surface recesses 550) of the rotor 535 as the rotor rotates in use, and is substantially parallel to the longitudinal axis of rotation of the rotor. The flow channel 575 is formed in the interior surface 525 of the housing 515, with one longitudinal edge of the channel 575 being defined by the interior surface 525 of the housing 515 and the other longitudinal edge of the channel being defined by the diaphragm 560. The flow channel 575 is in fluid communication with the first fluid port 510. As can be seen from FIG. 12, the second fluid port 520 opens from the interior surface 525 of the housing 515 via aperture 595 and is located such that upon rotation of the rotor 535 the second fluid port 520 is in direct fluid flow communication with the fluid-conveying chambers 555 via aperture 595.

The pump 500 further comprises a diaphragm chamber 580 provided by side walls 585 extending from the housing and closed with a cap 590. The diaphragm chamber 580 surrounds and encloses the rear surface 570 of the diaphragm 560. The diaphragm chamber 580 will contain pressurising means (not shown), arranged to urge the diaphragm 560) into contact with the surface of the rotor 535.

In use, fluid flows into the pump 500 through first fluid port 510 and into the flow channel 575. Fluid flows along the flow channel 575 and passes from the surface thereof into the fluid-conveying chambers 555. As the rotor 535 rotates, the fluid chambers 555 convey fluid around the cavity 530 formed within the housing 515 towards the second fluid port 520. The action of the pressurising means (not shown) urges the diaphragm 560 into contact with the rotor 535. Due to the resiliently deformable nature of the diaphragm 560, the diaphragm 560 remains in contact with the rotor 535 as the rotor rotates, thus conforming to the changing surface profile of the rotor 535. The action of the diaphragm 560 on the recessed surfaces 550 of the rotor 535 displaces the fluid from the cavities 555, through aperture 595 and out of the pump through the second fluid port 520.

The invention claimed is:

1. A pump comprising, a first fluid port and a second fluid port, a housing having an interior surface defining a cavity in which a rotor is located, the rotor, being rotatably mounted within the housing and having a longitudinal axis of rotation, and comprising, a housing engaging surface area forming a sealing interference fit with the interior surface of the housing, and at least one surface recess that forms with said interior surface of the housing a fluid-conveying chamber that, on rotation of the rotor, conveys fluid from the first fluid port to the second fluid port, a resiliently deformable diaphragm providing part of the interior surface of the housing, the resiliently deformable diaphragm comprising a rotor engaging surface and a rear surface opposite the rotor engaging surface, the rotor engaging surface of the resiliently deformable diaphragm being urged into contact with the rotor by a pressure source acting on the rear surface of the resiliently deformable diaphragm, a pair of flow channels being associated with the resiliently deformable diaphragm, the flow channels extending longitudinally from opposite ends of the rotor to overlie the surface recess of the rotor, as the rotor rotates in use, the pair of flow channels comprising a first flow channel in fluid communication with the first fluid port and being closed to the second fluid port and a second flow channel being closed to the first fluid port and being in fluid communication with the second fluid port, with each flow channel being located at opposite sides of the resiliently deformable diaphragm.

2. A pump according to claim 1, wherein the first flow channel and the second flow channel are essentially parallel to each other.

3. A pump according to claim 1, comprising a plurality of resiliently deformable diaphragms.

4. A pump according to claim 1, comprising two of the resiliently deformable diaphragms, which are located in the interior surface of the housing on diametrically opposite sides of the rotor.

5. A pump according to claim 1, comprising two of the resiliently deformable diaphragms, which are located on diametrically opposite sides of the rotor, and the rotor having four surface recesses that form with said interior surface of four fluid-conveying chambers that, on rotation of the rotor, convey fluid from the first fluid port to the second fluid port.

6. A pump according to claim 1, comprising two of the resiliently deformable diaphragms, which are located on diametrically opposite sides of the rotor, and the rotor having five surface recesses that form with said interior surface of five fluid-conveying chambers that, on rotation of the rotor, convey fluid from the first fluid port to the second fluid port.

7. A pump according to claim 1, comprising two of the resiliently deformable diaphragms, which are located on diametrically opposite sides of the rotor, and the rotor having three surface recesses that form with said interior surface of three fluid-conveying chambers that, on rotation of the rotor, convey fluid from the first fluid port to the second fluid port.

8. A pump according to claim 1, comprising three of the resiliently deformable diaphragms, which are located equidistantly about the circumference of the rotor.

9. A pump according to claim 1, wherein the pump comprises a diaphragm chamber surrounding the rear surface of the resiliently deformable diaphragm.

10. A pump according to claim 9, comprising a plurality of diaphragm chambers in fluid flow communication.

11. A pump according to claim 9, wherein a plurality of resiliently deformable diaphragms share one diaphragm chamber.

12. A pump according to claim 1, comprising a first chamber formed within the housing arranged such that the first flow channel is in direct fluid flow communication with the first chamber, and a second chamber formed within the housing arranged such that the second flow channel is in fluid flow communication with the second chamber.

13. A pump according to claim 12, wherein the first fluid port opens directly into the first chamber.

14. A pump according to claim 12, wherein the second fluid port is in fluid flow communication with the second chamber.

15. A pump according to claim 12, wherein the second chamber is provided by a diaphragm chamber, which diaphragm chamber is in fluid flow communication with the second fluid port.

16. A pump according to claim 12, wherein the second chamber is in separate fluid flow with a diaphragm chamber and the second fluid port.

17. A pump according to claim 1, comprising a one-way valve located between the second flow channel and the second fluid port.

18. A pump according to claim 17, comprising a second fluid chamber, wherein the one-way valve is located between the second fluid chamber and the second fluid port.

19. A pump according to claim 17, comprising a second chamber in fluid flow communication with a diaphragm chamber, and a one-way valve located between the second chamber and diaphragm chamber.

20. A pump according to claim 17, comprising a diaphragm chamber in fluid flow communication with the second flow channel, and a one-way valve located between the diaphragm chamber and the second fluid port.

21. A pump according to claim 1, comprising a diaphragm chamber and a pressure bypass valve located between the diaphragm chamber and the fluid-conveying chamber.

22. A pump according to claim 1, wherein the pressure source comprises at least one of a block of resilient material, a resilient tube of material, a spring, a hydraulic fluid, or a pneumatic fluid.

23. A pump comprising, a first fluid port and a second fluid port, a housing having an interior surface defining a cavity in which a rotor is located, the rotor that is rotatably mounted within the housing and has a longitudinal axis of rotation, the rotor comprising a housing engaging surface area forming a sealing interference fit with the interior surface of the housing and at least one surface recess that forms with said interior surface of the housing a fluid-conveying chamber that, on rotation of the rotor, conveys fluid from the first fluid port to the second fluid port, a resiliently deformable diaphragm providing part of the interior surface of the housing, the resiliently deformable diaphragm comprising a rotor engaging surface and a rear surface opposite the rotor engaging surface, the rotor engaging surface of the resiliently deformable diaphragm being urged into contact with the rotor by a pressurising means acting on the rear surface of the resiliently deformable diaphragm, a flow channel being associated with a leading edge of the resiliently deformable diaphragm, the flow channel extending longitudinally from one end of the rotor to overlie the surface recess of the rotor as the rotor rotates in use, the flow channel being in fluid communication with the first fluid port, wherein the flow channel is provided by a channel extending longitudinally along the length of the resiliently deformable diaphragm, substantially parallel to the longitudinal axis of rotation of the rotor, and an aperture opening from the interior surface of the housing and being associated with the following edge of the resiliently deformable diaphragm and located to overlie the surface recess of the rotor as the rotor rotates in use, such that upon rotation of the rotor the second fluid port is in direct fluid flow communication with the fluid-conveying chamber via the aperture.

24. A pump according to claim 23, wherein the aperture is formed in the interior surface of the housing adjacent the following edge of the resiliently deformable diaphragm and located to overlie the surface recess of the rotor as the rotor rotates in use.

25. A pump according to claim 23, wherein an aperture port is formed in the resiliently deformable diaphragm, adjacent the following edge and located to overlie the surface recess of the rotor as the rotor rotates in use.

26. A pump according to claim 23, wherein the aperture is formed partially in the resiliently deformable diaphragm and partially in the interior surface of the housing across the following edge of the resiliently deformable diaphragm and located to overlie the surface recess of the rotor as the rotor rotates in use.

27. A pump according to claim 23, wherein the flow channel is formed in the resiliently deformable diaphragm.

28. A pump according to claim 23, wherein the flow channel is formed in the interior surface of the housing.

29. A pump according to claim 23, wherein the flow channel extends linearly, substantially parallel with the longitudinal axis of rotation of the rotor.

30. A pump according to claim 23, wherein one longitudinal edge of the channel is defined by the interior surface of the housing, and the other longitudinal edge of the channel is defined by the resiliently deformable diaphragm.

31. A pump according to claim 23, wherein the housing comprises a resilient material.

32. A pump according to claim 23, wherein the resiliently deformable diaphragm is unitary with the housing.

33. A pump according to claim 23, wherein the resiliently deformable diaphragm is attached to the housing with a hermetic seal creating a continuous rotor engaging surface as the interior surface of the housing.

34. A pump according to claim 23, wherein the pump comprises a diaphragm chamber surrounding the rear surface of the resiliently deformable diaphragm.

35. A pump according to claim 23, wherein the pressurising means is selected from the group comprising a spring, a block of resilient material, a resilient tube of material, and/or a fluid acting on the rear surface of the resiliently deformable diaphragm.

36. A pump according to claim 23, wherein the surface recess does not extends at least partially along the axial length of the rotor.

37. A pump according to claim 23, wherein the rotor comprises a unitary housing engaging surface area extending around the circumference of the rotor at each end and joined by a land extending between each end of the rotor and between each surface recess.

38. A pump according to claim 23, wherein the rotor has a plurality of surface recesses that form with said interior surface of the housing a corresponding number of conveying chambers that, on rotation of the rotor, convey fluid from the first fluid port to the second fluid port.

39. A pump according to claim 38, wherein the plurality of surface recesses is arranged equidistantly about the circumference of the rotor.

40. A pump according to claim 23, wherein the rotor has a plurality of surface recesses that form with said interior surface of the housing a corresponding number of conveying chambers that, on rotation of the rotor, convey fluid from the first fluid port to the second fluid port and the pump comprises at least one less resiliently deformable diaphragm than the number of surface recesses on the rotor.

41. A pump according to claim 23, comprising a diaphragm chamber in fluid flow communication with the aperture and the second fluid port, and a one-way valve located between the diaphragm chamber and aperture.

42. A pump according to claim 23, comprising a diaphragm chamber and a pressure bypass valve located between the diaphragm chamber and the first fluid port.

* * * * *